US011260494B2

(12) United States Patent
Bonazzoli

(10) Patent No.: US 11,260,494 B2
(45) Date of Patent: Mar. 1, 2022

(54) DEVICES FOR SURFACE FINISHING OF PARTS

(71) Applicant: Best Finishing S.r.l., Milan (IT)

(72) Inventor: Marco Bonazzoli, Milan (IT)

(73) Assignee: BEST FINISHING S.R.L., Milan (IT)

( * ) Notice: Subject to any disclaimer, the term of this patent is extended or adjusted under 35 U.S.C. 154(b) by 0 days.

(21) Appl. No.: 17/059,143

(22) PCT Filed: May 27, 2019

(86) PCT No.: PCT/IB2019/054380
§ 371 (c)(1),
(2) Date: Nov. 25, 2020

(87) PCT Pub. No.: WO2019/229631
PCT Pub. Date: Dec. 5, 2019

(65) Prior Publication Data

US 2021/0205947 A1 Jul. 8, 2021

(30) Foreign Application Priority Data

May 28, 2018 (IT) ..... 102018000005751

(51) Int. Cl.
*B24B 31/073* (2006.01)
*B24B 31/06* (2006.01)
*B24B 1/04* (2006.01)

(52) U.S. Cl.
CPC ..... *B24B 31/073* (2013.01); *B24B 1/04* (2013.01); *B24B 31/06* (2013.01)

(58) Field of Classification Search
CPC ..... B24B 1/04; B24B 31/06; B24B 31/062; B24B 31/073

(Continued)

(56) References Cited

U.S. PATENT DOCUMENTS 3,071,900 A * 1/1963 Balz ..... B24B 31/06 451/326
3,848,373 A * 11/1974 Pletscher ..... B24B 31/02 451/32

(Continued)

FOREIGN PATENT DOCUMENTS

EP 0225417 A1 6/1987
GB 2027372 A 2/1980

OTHER PUBLICATIONS

International Search Report and Written Opinion in corresponding International Application No. PCT/IB2019/054380 dated Sep. 10, 2019, 10 pages.

*Primary Examiner* — Eileen P Morgan
(74) *Attorney, Agent, or Firm* — MH2 Technology Law Group LLP

(57) ABSTRACT

A device for surface finishing of parts may include: an annular container configured to receive working media and at least one part, the container having a central axis and bottom surface; vibratory means associated with the container for causing the container to oscillate, wherein the vibratory means is configured to cause the at least one part to circulate in the container along a path; and at least one projection on the bottom surface and having a crest extending along a respective radial direction, an ascending lateral surface from the bottom surface to the crest, and a descending lateral surface from the crest to the bottom surface. The device may further include a plurality of the projections. The projections may change a spatial orientation of the at least one part as it moves on the projections. The crest may be inclined with respect to the radial direction downwards toward the axis.

17 Claims, 2 Drawing Sheets

(58) Field of Classification Search
USPC ..... 451/32, 35, 326, 327
See application file for complete search history.

(56) References Cited

U.S. PATENT DOCUMENTS 4,081,929 A 4/1978 Jones et al.
4,184,290 A * 1/1980 Rampe ..... B24B 31/073
451/327
4,205,491 A * 6/1980 Nishiya ..... B24B 31/073
451/327
4,757,648 A * 7/1988 Carpenter ..... B24C 3/26
164/404
5,237,778 A * 8/1993 Baer ..... B24B 31/06
134/118

* cited by examiner

DEVICES FOR SURFACE FINISHING OF PARTS

CROSS-REFERENCE TO RELATED APPLICATION(S)

This application is a national stage entry from International Application No. PCT/M2019/054380, filed on May 27, 2019, in the Receiving Office ("RO/IB") of the International Bureau of the World Intellectual Property Organization ("WIPO"), and published as International Publication No. WO 2019/229631 A1 on Dec. 5, 2019; international Application No. PCT/IB2019/054380 claims priority from Italian Patent Application No. 102018000005751, filed on May 28, 2018, in the Italian Patent and Trademark Office ("WTO"), the entire contents of all of which are incorporated herein by reference.

TECHNICAL FIELD OF THE INVENTION

The present invention relates to a device for surface finishing of parts. Such device is useful in particular in the last steps of industrial productions to provide a specific surface finishing to a mechanical component. More in detail, the device subject of the present invention can be used to carry out working processes as for example deburring, grinding, polishing and even more.

STATE OF THE ART

It is known in the state of the art a device for surface finishing of parts. Such device comprises a substantially toroidal-shaped container open on top. A motor adapted to cause the vibration of the container itself is installed at the base of the container.

In order to carry out the working process, the container is filled with a plurality of solid fragments, called "media" in the technical jargon of the field. Such media are selected based on shape, size and level of abrasiveness according to the working process to be carried out. Optionally, a liquid additive can be inserted together with the media.

To carry out the treatment, one or more parts are inserted into the container together with the media such that, once the motor is actuated, the repeated friction between the parts and media and the subsequent grinding give each part the required surface finishing.

The above described machine and process have been employed for a long time with satisfactory results. It is noted, however, that when parts have holes or cavities this type of processing is difficult, resulting in a lengthening of working times, as, in order to obtain the same type of finishing it is required to leave components inside the machine for a longer time.

Furthermore, while finishing several parts simultaneously, these tend to adhere between them. This occurs especially in case parts have plane surfaces and with the presence of water in the container together with the media, which is often required in many working processes.

Document U.S. Pat. No. 4,081,929 is further known in the art. The device is used for finishing parts by means of using draining means for removing fluids, dust and small-size particles from the working system. Such device has a single projection adapted to remove fluids and dust.

SUMMARY OF THE INVENTION

In this background, the technical task underlying the present invention is to propose a device for surface finishing of parts that overcomes the aforementioned drawbacks of the prior art.

In particular, it is an object of the present invention to make available a device for the surface finishing of parts that is able to improve the finishing of parts having holes, cavities or similar features.

A further object of the present invention is to make available a device for surface finishing of parts able to prevent parts from adhering between them during treatment.

Another object of the present invention is to make available a device for surface finishing of parts able to reduce working times with parts being equally finished.

The defined technical task and the specified objects are substantially reached by a device for surface finishing of parts comprising the technical characteristics set forth in one or more of the enclosed claims.

In particular, one embodiment of a device for surface finishing of parts according to the present invention comprises an annular container. Such container is configured to receive a plurality of working media and at least a part to be treated. The container has a central axis and a bottom surface.

The device further comprises vibratory means associated with the container. Such vibratory means are intended to cause the container to oscillate. Furthermore, vibratory means are arranged to cause the part to circulate inside the container along a pre-established feeding path.

The bottom surface of the container has a plurality of projections preferably angularly equally spaced between them with respect to the central axis. Such projections are configured to change the spatial orientation of the part as it moves thereon.

Advantageously, the device according to the invention limits adhesions during the working step. While two adhering components move on a projection, in fact, each will be re-oriented in a different and substantially casual way. This makes it possible for the adhesion to be broken soon after being formed, thus avoiding a negative effect on the working process.

Such device further allows to process efficiently pieces with cavities or holes as, while moving on the projections, the spatial orientation of the part is changed. Consequently, media are periodically inserted and/or removed from the cavity or the hole, exerting their abrasive action with a greater continuity also inside parts that are difficult to reach as for instance cavities or holes.

Finally, it must be noted that projections promote a higher randomness in media movement with respect to the part. This results in a higher evenness of surface processing, which leads to a working process time even lower of 30% with respect to the machines of the known art, the result being equal.

LIST OF FIGURES

Further characteristics and advantages of the present invention will appear more evident from the indicative and non-limiting description of a preferred but not exclusive embodiment of a device for surface finishing of parts, as illustrated in the enclosed drawings wherein.

Figure 1:
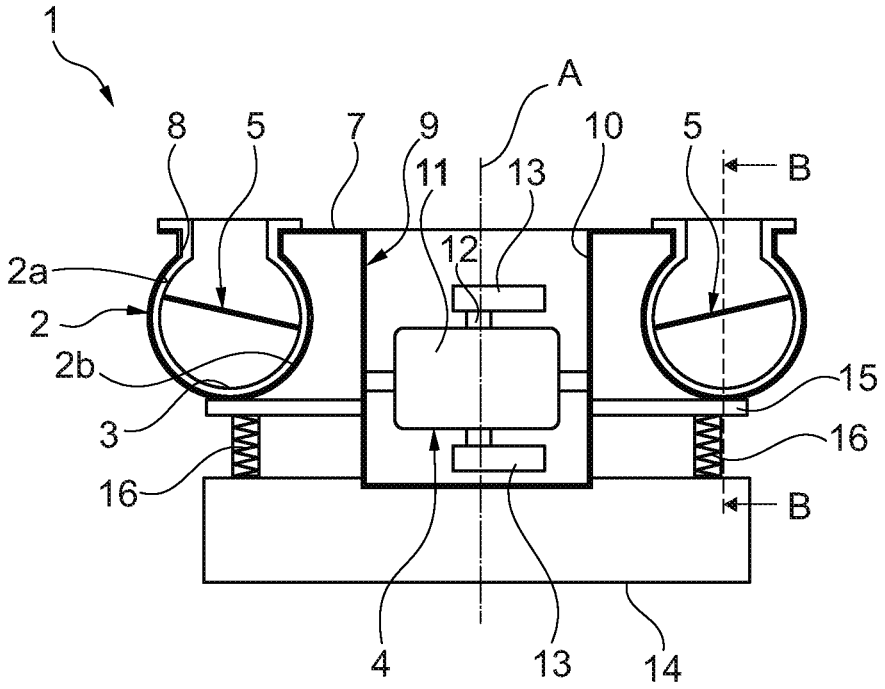
FIG. 1 is a sectional front view of a device for surface finishing of parts according to the present invention.
Figure 2:
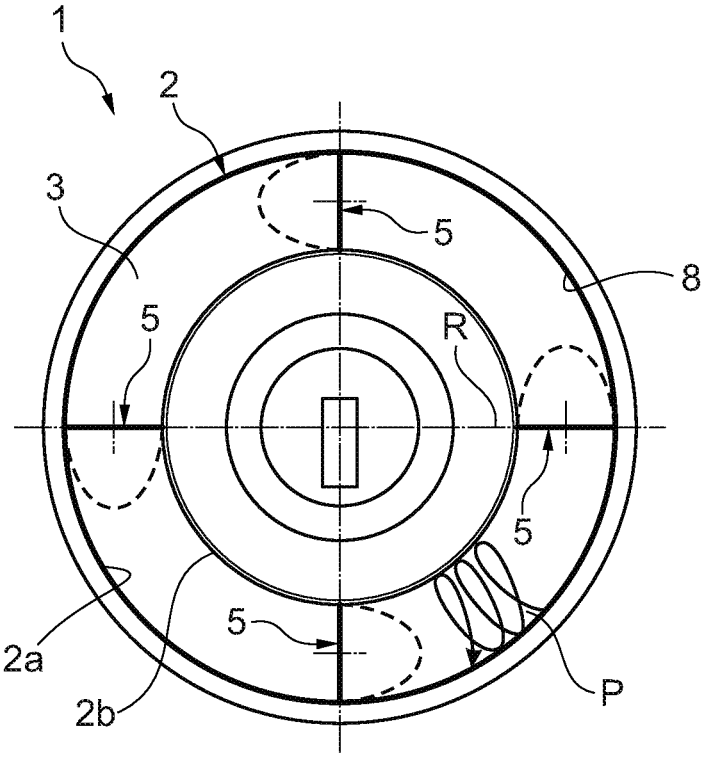
FIG. 2 is a view from above of the device of FIG. 1.
Figure 3A:
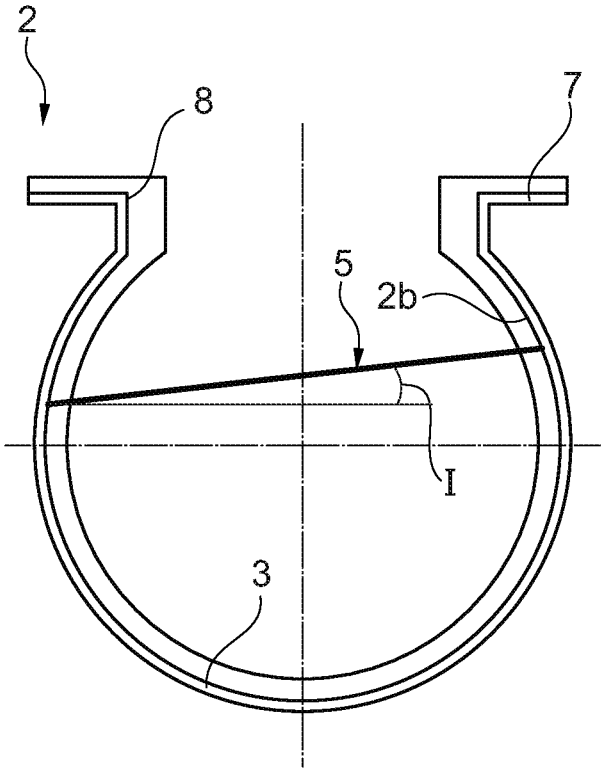
Figure 3B:
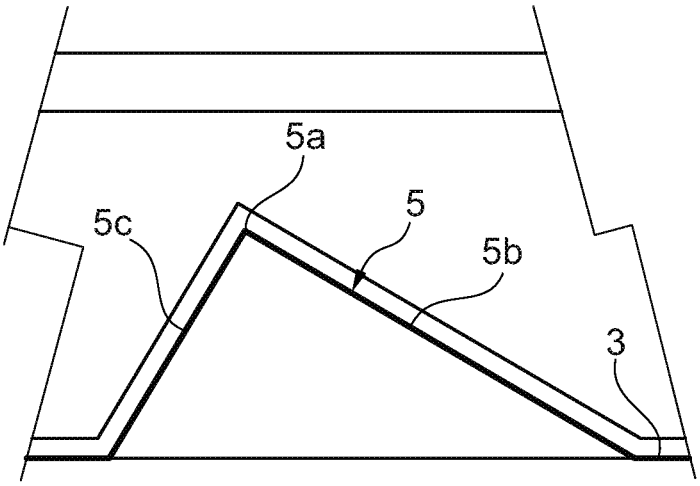

FIG. 3*a* is a sectional detail of the device of FIG. 1 along line B-B; and FIG. 3*b* is a further detail of the device of FIG. 1.

DETAILED DESCRIPTION

Referring to the enclosed figures, a device for surface finishing of parts according to the present invention is indicated by 1.

Referring in particular to FIG. 1, the device 1 comprises a base 14, adapted to be laid on and/or fixed to a fixed external surface, for example a floor. A movable platform 15 is arranged on the base 14, in particular it is linked thereto by means of a plurality of elastic shock absorbers 16. Such shock absorbers 16 are made in a way known to the person skilled in the art, and comprise for instance some springs.

The device 1 comprises an annular container 2, having a central axis "A" and a bottom surface 3. In particular, the container 2 is fixed to the above-mentioned movable platform 15. Such container 2 is adapted to receive one or more parts to be treated. To this end, the container 2 is configured to receive a plurality of working media. In the background of the present invention, "medium" means a solid element adapted to react with each part through friction and/or rubbing. Working media are selected according to their physical properties, in particular shape, size and degree of abrasiveness, according to the specific working process to be implemented.

In greater detail, container 2 has one first inner lateral surface 2*a* surrounding one second inner lateral surface 2*b*. Such inner lateral surfaces 2*a*, 2*b* each have a respective bulge. Such bulges each define a respective inner concavity inside the container 2.

Referring in particular to FIG. 1, an upper wall 7 is placed above container 2. Such upper wall 7 has an annular opening 8 directly communicating with the inside of the container 2.

The device 1 further comprises vibratory means 4, which are associated with container 2 such as to cause it to oscillate. Vibratory means 4 are configured to cause the part inside the container to circulate along a feeding path "P". In particular, the path "P" is preferably a toroidal-spiral path, i.e. it makes up a circular motion lying on a radial plane of container 2 and a movement along directions tangential to the container 2 itself. In other words, the path "P" is given by a movement of the part along inner lateral surfaces 2*a*, 2*b* and the bottom surface 3 of the container 2.

In greater detail, the device comprises a housing 9 in a single piece with the container 2, where the aforementioned vibratory means 4 are housed. The housing 9 has a cylindrical shape, and it is placed inside the toroidal ring defined by the container 2. In particular, the housing 9 is defined by a cylindrical wall 10 arranged coaxially with respect to the central axis "A" of container 2.

In further detail, vibratory means 4 comprise a motor 11 actuating, by means of a shaft 12, a torque of eccentric masses 13. The motor 11 is in particular fixed to the cylindrical wall 10 of the housing 9, so as to transmit to container 2 the vibration generated by the rotation of the eccentric masses 13.

Referring in particular to FIGS. 3*a*, 3*b*, it must be noted that the bottom surface 3 has a plurality of projections 5. In the preferred embodiment, projections 5 are arranged angularly equally spaced with respect to the central axis "A". In alternative embodiments, not shown, projections 5 can be distributed in any way around the central axis "A". Such projections 5 are configured such as to change the spatial orientation of the part as it moves thereon.

In one first embodiment of the invention, the bottom surface 3 has a number of projections 5 between two or more, in particular between two and six, preferably four. In alternative embodiments, not shown, the number of projections 5 can be any and, in particular, it can vary also according to the sizes of the container 2.

In detail, each projection 5 has a crest 5*a*. Such crest 5*a* develops along a radial direction "R" identified by the projection 5, i.e. a direction that joins the projection 5 with the central axis "A". Furthermore, crest 5*a* has a height between 50% and 80% of the height of the container 2 with respect to the bottom surface 3.

According to a preferred embodiment of the invention, the crest 5*a* has an inclination along the radial direction "R", in particular descending towards the center of the container 2 passed through by the central axis "A". Preferably, the crest 5*a* is inclined at an angle "I" less than 40°. Advantageously, the crest 5*a* inclination eases the rotation of the part, and allows to further reduce working times.

Each projection 5 has an ascending lateral surface 5*b*, which extends from the bottom surface 3 of the container 2 up until the crest 5*a*. Similarly, a descending lateral surface 5*c* extends from the crest 5*a* down until the bottom surface 3. It must be noted that lateral surfaces 5*b*, 5*c* have a descending inclination from the crest 5*a* down until the bottom surface 3.

The ascending lateral surfaces 5*b* and descending lateral surfaces 5*c* are so called as, in use, parts introduced in the container 2 overcome the projections 5 moving up along ascending lateral surfaces 5*b* and down along the descending lateral surfaces 5*c* of each projection 5. In greater detail, vibratory means 4 are configured to move the container 2 with an eccentric movement with respect to the central axis "A" according to one first rotation direction, thus feeding the part into the container 2 along the aforementioned path "P", in particular towards the projection 5 where an irregular movement of the part occurs making it possible to obtain the previously described advantages.

In greater detail, lateral surfaces 5*b*, 5*c* generally have a different inclination with respect to the bottom surface 3. In particular, the ascending lateral surface 5*b* has an inclination that ranges from 30° to 70°. The descending lateral surface 5*c* has an inclination that ranges from 40° to 70°. It must also be noted that the descending lateral surface 5*c* can be vertical.

According to one embodiment of the invention, the container 2 is provided with a plurality of holes (not shown) placed at the bottom surface 3. In particular, each hole is arranged between two respective projections 5. Each hole is provided with a valve (not shown) such that it can be opened/closed to allow or prevent the passage of fluid.

When the device 1 is in use, vibratory means 4 are actuated, such that the container 2 is put into vibration. The part is thus fed into the container up until it reaches the ascending lateral surfaces 5*b* of the projections 5 and is moved down along the descending lateral surfaces 5*c*.

In case the processing to be carried out envisages the use of a liquid additive together with the media, it is possible to selectively open or close each of the holes according to pre-established modes. In case the hole between two projections 5 is open, the liquid present therebetween is drained, while in the opposite case it is retained inside the container 2. Thanks to holes and projections 5, it is possible to implement a treatment in which parts alternatively move in tanks containing both liquid and media and in tanks containing only media.

The invention claimed is:

1. A device for surface finishing of parts, the device comprising:

an annular container configured to receive a plurality of working media and at least one part to be treated, the container having a central axis and a bottom surface;

vibratory means associated with the container for causing the container to oscillate, wherein the vibratory means is configured to cause the at least one part to circulate in the container along a feeding path; and at least one projection on the bottom surface and having a crest extending along a respective radial direction, an ascending lateral surface extending from the bottom surface up to the crest, and a descending lateral surface extending from the crest down to the bottom surface;

wherein the device further comprises a plurality of the projections, wherein the projections are configured to change a spatial orientation of the at least one part as the at least one part moves on the projections, and wherein the crest is inclined with respect to the radial direction downwards toward the central axis.

2. The device of claim 1, wherein an inclination of the crest with respect to the radial direction is less than 40°.

3. The device of claim 1, wherein the lateral surfaces have a downward inclination from the crest to the bottom surface.

4. The device of claim 1, wherein the crest has a height greater than or equal to 50% and less than or equal to 80% of a height of the container from the bottom surface.

5. The device of claim 1, wherein the ascending lateral surface has an inclination greater than or equal to 30° and less than or equal to 70° with respect to the bottom surface.

6. The device of claim 1, wherein the descending lateral surface has an inclination greater than or equal to 40° and less than or equal to 70° with respect to the bottom surface.

7. The device of claim 1, wherein the vibratory means is configured to move the container such that the at least one part is fed in the container and moved up the ascending lateral surfaces of the projections and down the descending lateral surfaces of the projections.

8. The device of claim 1, wherein a number of the projections is greater than or equal to two and less than or equal to six.

9. The device of claim 1, wherein the container has a first inner lateral surface with a bulge defining a first inner annular concavity in the container.

10. The device of claim 1, wherein the ascending lateral surface has a downward inclination from the crest to the bottom surface.

11. The device of claim 1, wherein the descending lateral surface has a downward inclination from the crest to the bottom surface.

12. The device of claim 1, wherein the descending lateral surface is vertical with respect to the bottom surface.

13. The device of claim 1, wherein a number of the projections is equal to two.

14. The device of claim 1, wherein a number of the projections is equal to three.

15. The device of claim 1, wherein a number of the projections is equal to four.

16. The device of claim 1, wherein a number of the projections is equal to five.

17. The device of claim 1, wherein a number of the projections is equal to six.

* * * * *